US007393190B2

(12) United States Patent
Lee et al.

(10) Patent No.: US 7,393,190 B2
(45) Date of Patent: Jul. 1, 2008

(54) DISCHARGE VALVE SYSTEM OF SCROLL COMPRESSOR

(75) Inventors: Byeong-Chul Lee, Seoul (KR); Byung-Kil Yoo, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/034,775

(22) Filed: Jan. 14, 2005

(65) Prior Publication Data

US 2006/0099098 A1 May 11, 2006

(30) Foreign Application Priority Data

Nov. 11, 2004 (KR) ..... 10-2004-0092066

(51) Int. Cl.

| | |
|---|---|
| ***F03C 2/00*** | (2006.01) |
| ***F03C 4/00*** | (2006.01) |
| ***F04C 2/00*** | (2006.01) |
| ***F01C 1/02*** | (2006.01) |

(52) U.S. Cl. ..... 418/55.1; 418/15; 418/270; 417/301; 417/310

(58) Field of Classification Search ..... 418/15, 418/55.1–55.6, 57, 270; 417/310, 301
See application file for complete search history.

(56) References Cited

U.S. PATENT DOCUMENTS 6,273,691 B1 * 8/2001 Morimoto et al. ..... 418/15

FOREIGN PATENT DOCUMENTS

| | | | |
|---|---|---|---|
| JP | 08247053 A | * | 9/1996 |
| JP | 09217691 A | * | 8/1997 |
| JP | 11022664 A | * | 1/1999 |
| JP | 2001329975 A | * | 11/2001 |
| KR | 1997-0045558 A | | 7/1997 |

* cited by examiner

*Primary Examiner*—Theresa Trieu
(74) *Attorney, Agent, or Firm*—Birch, Stewart, Kolasch & Birch, LLP

(57) ABSTRACT

A discharge valve system of a scroll compressor comprises: a fixed scroll having a discharge hole and discharge bypass holes; a discharge valve assembly mounted at the fixed scroll, for opening and closing the discharge hole by a pressure difference; and an integral bypass valve assembly mounted at the fixed scroll, for opening and closing the bypass holes and interworking the discharge valve assembly. According to this, a discharge amount of gas is maximized in a low pressure ration driving of the scroll compressor thereby to enhance a discharge efficiency. Also, the number of components is greatly reduced thus to reduce a fabrication cost. Also, the number of assembly processes is greatly reduced thereby to enhance an assembly productivity.

13 Claims, 9 Drawing Sheets

DISCHARGE VALVE SYSTEM OF SCROLL COMPRESSOR

BACKGROUND OF THE INVENTION

1. Field of the Invention

The present invention relates to a scroll compressor, and more particularly, to a discharge valve system of a scroll compressor capable of maximizing a discharge amount of gas compressed in a low pressure ratio operation and capable of minimizing the number of assembly processes by simplifying components.

2. Description of the Conventional Art

Generally, a compressor converts electric energy into kinetic energy, and compresses refrigerant gas by the kinetic energy. The compressor is a core component constituting a refrigerating cycle system, and includes various kinds such as a rotary compressor, a scroll compressor, a reciprocal compressor, etc. according to a compression mechanism for compressing a refrigerant. The compressors are used in a refrigerator, an air conditioner, a showcase, etc. The scroll compressor is divided into a motor part for generating a rotational force; and a compression part for sucking, compressing, and discharging gas by receiving a driving force of the motor part while an orbiting scroll is orbit-motioned with being engaged with a fixed scroll.

FIGS. 1 and 2 are sectional views showing a compression part of a scroll compressor in accordance with the conventional art.

As shown, the compression part of the scroll compressor includes: a fixed scroll 30 mounted in a hermetic container with a certain gap from an upper frame 20 mounted in the hermetic container 10; an orbiting scroll 40 positioned between the upper frame 20 and the fixed scroll 30 to be orbiting-movably engaged with the fixed scroll 30; an oldham ring 50 positioned between the orbiting scroll 40 and the upper frame 20, for preventing a rotation of the orbiting scroll 40; a high/low pressure division plate 11 coupled to the hermetic container 10 with the fixed scroll 30, for dividing inside of the hermetic container 10 into a high pressure region and a low pressure region; and a discharge valve assembly 60 mounted at an upper surface of the fixed scroll 30, for opening and closing a discharge hole 31 formed at the fixed scroll 30.

The orbiting scroll 40 is connected to an eccentric portion 71 of a rotation shaft 70 inserted into the upper frame.

A suction pipe 12 for sucking gas is connected to one side of the hermetic container 10 positioned at the low pressure region, and a discharge pipe 13 for discharging gas is connected to one side of the hermetic container 10 positioned at the high pressure region.

An unexplained reference numeral 32 denotes a wrap of the fixed scroll 30 protruded as an involute curve shape, 41 denotes a wrap of the orbiting scroll 40 protruded as an involute curve shape, and B are bushes.

An operation of the compression part of the scroll compressor will be explained as follows.

First, when the rotation shaft 70 is rotated by receiving a rotational force of the motor part, the orbiting scroll 40 coupled to the eccentric portion 71 of the rotation shaft is orbitingly-moved by having the rotation shaft 70 as a center axis. The orbiting scroll 40 performs an orbiting movement while a rotation thereof is prevented by the oldham ring 50.

As the orbiting scroll 40 performs an orbiting movement, the wrap 41 of the orbiting scroll 40 performs an orbiting movement with being engaged with the wrap 32 of the fixed scroll 30. According to this, a plurality of compression pockets P formed by the wrap 41 of the orbiting scroll 40 and the wrap 32 of the fixed scroll 30 move towards center portions of the fixed scroll 30 and the orbiting scroll 40, and at the same time, volumes of the compression pockets P are varied thereby to suck gas, compress the gas, and discharge the gas through the discharge hole 31 of the fixed scroll 30.

The gas of a high temperature and a high pressure discharged through the discharge hole 31 of the fixed scroll 30 passes through the high pressure region, and is discharged outside the hermetic container 10 through the discharge pipe 13.

The scroll compressor is mainly mounted at an air conditioner with a refrigerating cycle system. At this time, the scroll compressor is operated in a low pressure ratio or a high pressure ratio by considering an efficiency of the scroll compressor according to an installation condition or a driving condition of the air conditioner.

In case that the scroll compressor is operated in a low pressure ratio, gas compressed in the compression pocket P formed by the wrap 32 of the fixed scroll 30 an the wrap 41 of the orbiting scroll 40 is discharged as a middle pressure state through a bypass hole 33 formed at a middle region of the fixed scroll 30. Also, in case that the scroll compressor is operated in a high pressure ratio, gas compressed in the compression pocket P formed by the wrap 32 of the fixed scroll 30 an the wrap 41 of the orbiting scroll 40 is discharged as a high pressure state through the pass hole 31 of the fixed scroll 30.

In case that the scroll compressor is operated in a low pressure ratio or a high pressure ratio, a discharge valve system for discharging gas of a middle pressure state and a high pressure state is provided at the fixed scroll 30.

FIG. 3 is a perspective view showing a discharge valve system of a scroll compressor in accordance with the conventional art, and FIG. 4 is a front sectional view showing a part of the discharge valve system.

As shown, in the discharge valve system, the discharge hole 31 is penetratingly-formed in the middle of the fixed scroll 30. A first double bypass hole 33 having two through holes adjacent to the fixed scroll 30 is formed at one side of the discharge hole 31, and a second double bypass hole 33 having two through holes adjacent to the fixed scroll 30 is formed at another side of the discharge hole 31.

A discharge valve assembly 60 for opening and closing the discharge hole 31 is mounted at an upper surface of the fixed scroll 30. The discharge valve assembly 60 is composed of: a discharge valve 61 formed as a thin plate of a certain shape, for opening and closing the discharge hole 31; a retainer 62 for supporting the discharge valve 61; and a fixing bolt 63 for fixing one side of the discharge valve 61 and the retainer 62.

A first bypass valve assembly 80 for opening and closing the first double bypass hole 33 is mounted at an upper surface of the fixed scroll 30. The first bypass valve assembly 80 is composed of: a bypass valve 81 for opening and closing the first double bypass hole 33; a retainer 82 for supporting the bypass valve 81; and a fixing bolt 83 for fixing one side of the bypass valve 81 and the retainer 82.

A second bypass valve assembly 80 for opening and closing the second double bypass hole 33 is mounted at an upper surface of the fixed scroll 30. The second bypass valve assembly 80 is composed of: a bypass valve 81 for opening and closing the second double bypass hole 33; a retainer 82 for supporting the bypass valve 81; and a fixing bolt 83 for fixing one side of the bypass valve 81 and the retainer 82.

Valve seats 34 protruded by grooves formed as a certain shape with a certain depth are respectively formed at an upper surface of the fixed scroll 30 positioned around the discharge hole 31 and the first/second double bypass holes 33. The valve seats 34 has a constant height.

An unexplained reference numeral 35 denotes a starting bypass hole for discharging liquid refrigerant at the time of introducing liquid refrigerant, and 90 denotes a starting bypass valve assembly for opening and closing the driving bypass hole.

In the discharge valve system, in case that the scroll compressor mounted at an air conditioner, etc. is operated in a high pressure ratio, the orbiting scroll 40 performs an orbiting movement. As the orbiting scroll 40 performs an orbiting movement, a plurality of compression pockets P formed by the wrap 41 of the orbiting scroll 40 and the wrap 32 of the fixed scroll 30 move towards a center portion of the fixed scroll 30, and at the same time, volumes of the compression pockets P are gradually decreased thereby to compress gas. The compressed gas is discharged through the discharge hole 31 positioned in the middle of the fixed scroll 30 while the discharge valve 61 is opened. At this time, since the high pressure region of the hermetic container 10 maintains a high pressure state, the first and second bypass valve assemblies 80 block the first and second double bypass holes 33.

In the discharge valve system, in case that the scroll compressor mounted at an air conditioner, etc. is operated in a low pressure ratio, the orbiting scroll 40 performs an orbiting movement. As the orbiting scroll 40 performs an orbiting movement, a plurality of compression pockets P formed by the wrap 41 of the orbiting scroll 40 and the wrap 32 of the fixed scroll 30 move towards a center portion of the fixed scroll 30, and at the same time, volumes of the compression pockets P are gradually decreased thereby to compress gas. The compressed gas does not move up to the discharge hole 31 positioned in the middle of the fixed scroll 30, but is discharged through the first and second double bypass holes 33 of the fixed scroll 30 while the first and second bypass valves 80 are opened. At this time, the discharged gas has a pressure relatively lower than that of the gas discharged through the discharge hole 31. Since the high pressure region of the hermetic container 10 maintains a low pressure state, the first and second bypass valve assemblies 80 are opened.

However, in the conventional discharge valve system of a scroll compressor, the size of the first and second double bypass holes 33 can not be increased. According to this, gas compressed in a low pressure ratio can not be sufficiently discharged through the first and second bypass holes.

Also, since components constituting the discharge valve system are relatively much required, the number of assembly processes is increased. According to this, there is a difficulty in mass-producing the discharge valve system, an assembly productivity is lowered, and a fabrication cost is increased.

SUMMARY OF THE INVENTION

Therefore, an object of the present invention is to provide a discharge valve system of a scroll compressor capable of maximizing a discharge amount of gas compressed in a low pressure ratio operation and capable of minimizing the number of assembly processes by simplifying components.

To achieve these and other advantages and in accordance with the purpose of the present invention, as embodied and broadly described herein, there is provided a discharge valve system of a scroll compressor comprising: a fixed scroll having a discharge hole and discharge bypass holes; a discharge valve assembly mounted at the fixed scroll, for opening and closing the discharge hole by a pressure difference; and an integral bypass valve assembly mounted at the fixed scroll, for opening/closing the bypass holes and interworking the discharge valve assembly.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
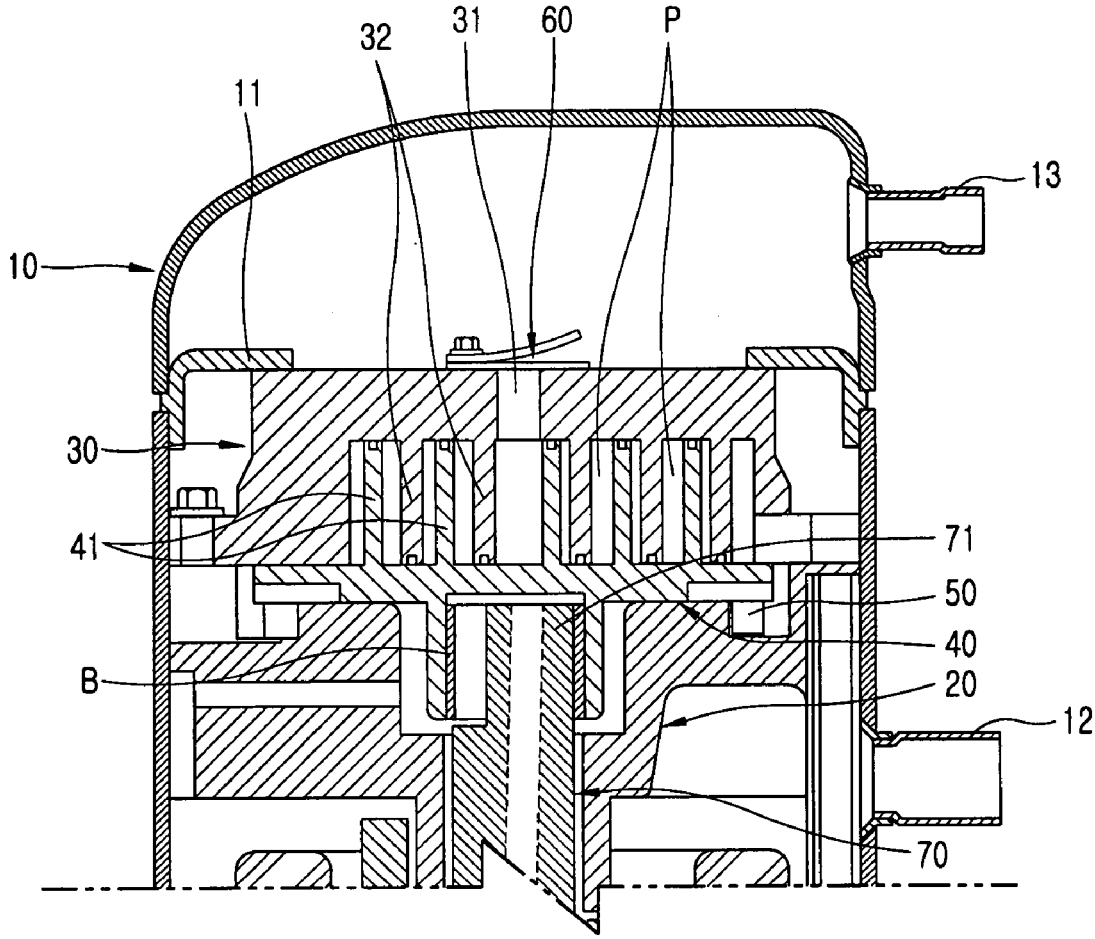
FIG. 1 CONVENTIONAL ART
FIGS. 1 and 2 are respectively a front sectional view and a plane sectional view showing a compression part of a scroll compressor in accordance with the conventional art.
Figure 2:
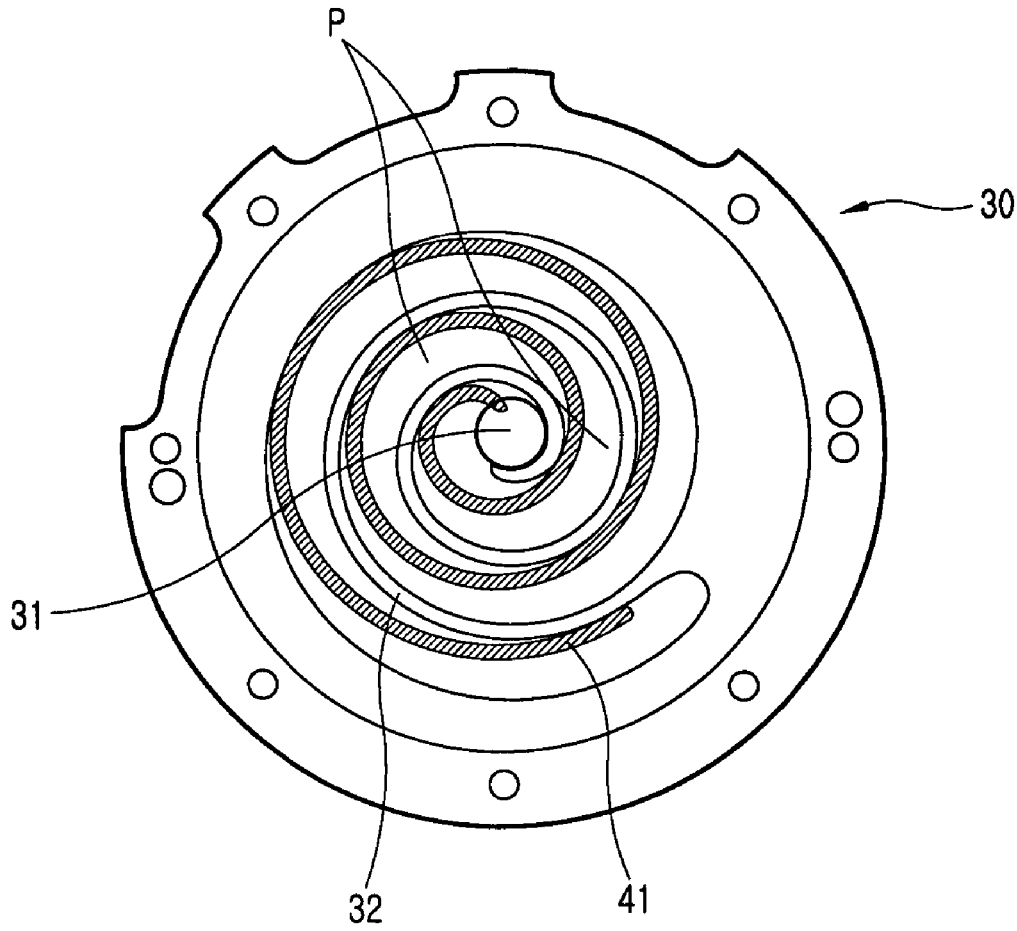
FIG. 2 CONVENTIONAL ART
Figure 3:
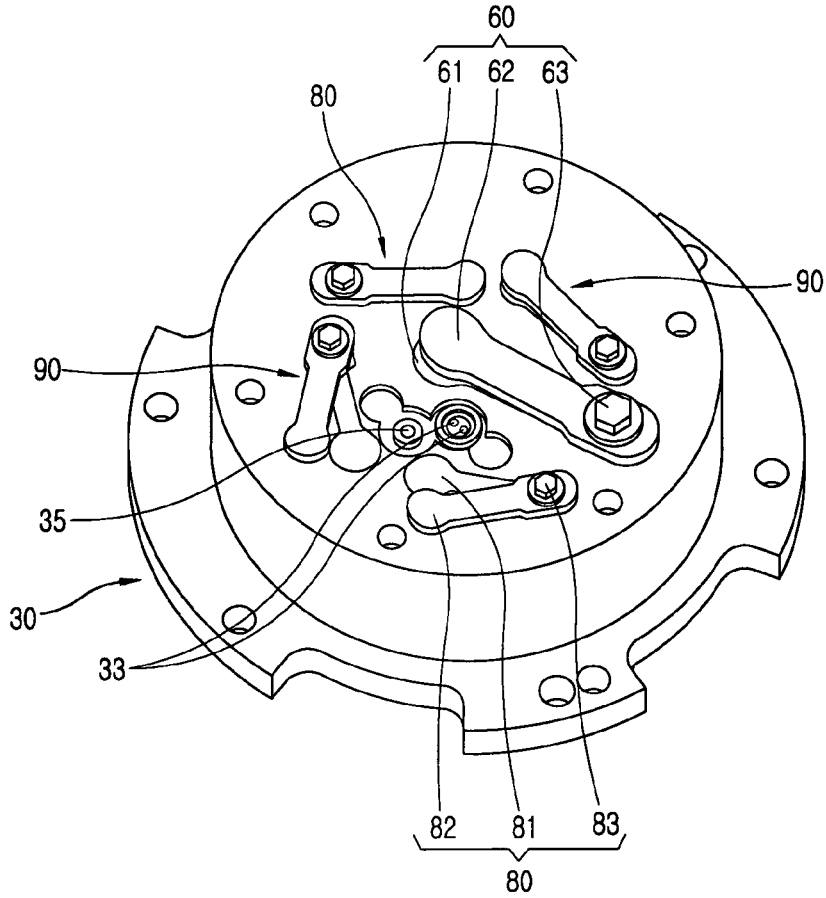
FIG. 3 CONVENTIONAL ART
FIGS. 3 and 4 are respectively a perspective view and a front sectional view showing a discharge valve system of the scroll compressor in accordance with the conventional art.
Figure 4:
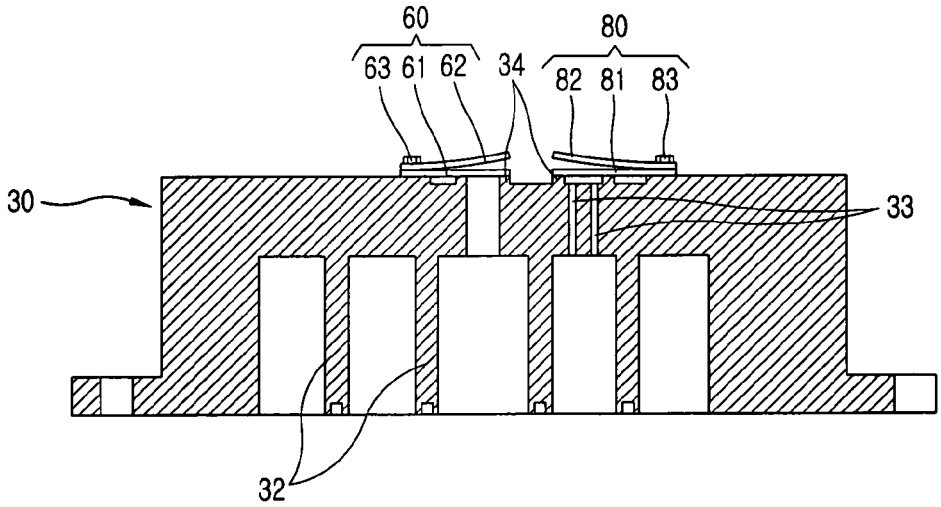
FIG. 4 CONVENTIONAL ART
Figure 5:
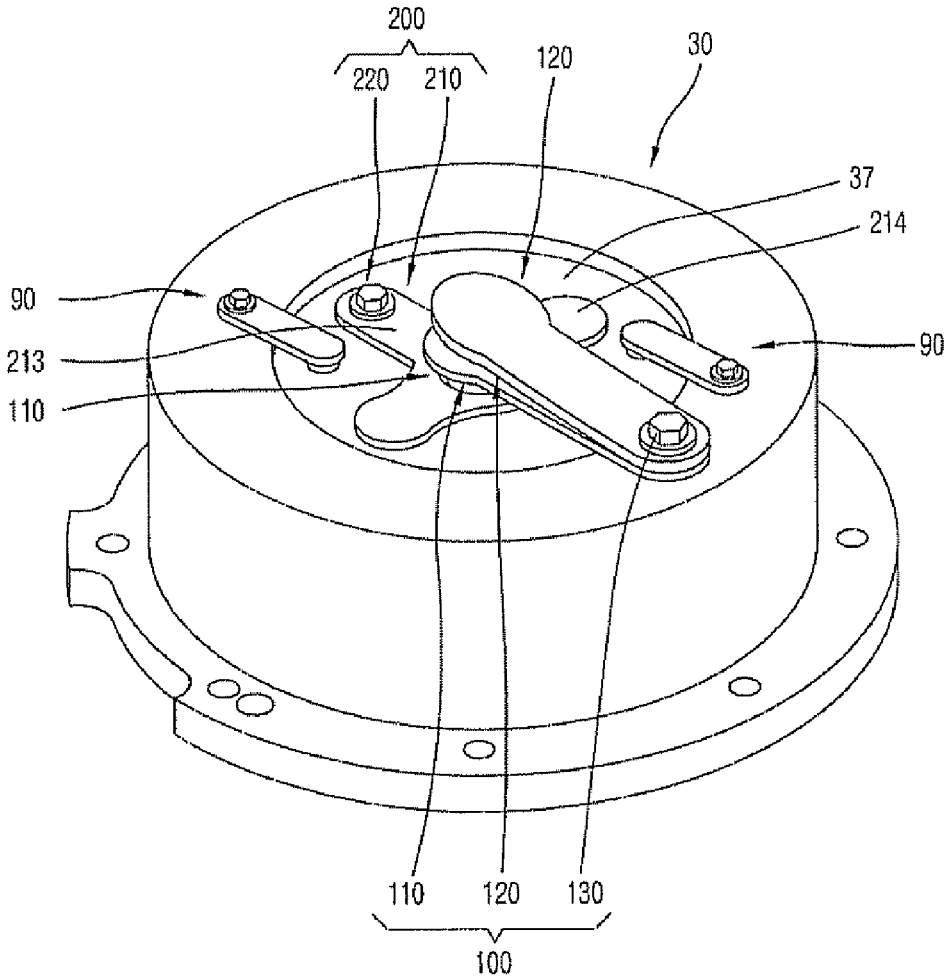
FIG. 5 is a perspective view showing a fixed scroll having a discharge valve system of a scroll compressor according to the present invention.
Figure 6:
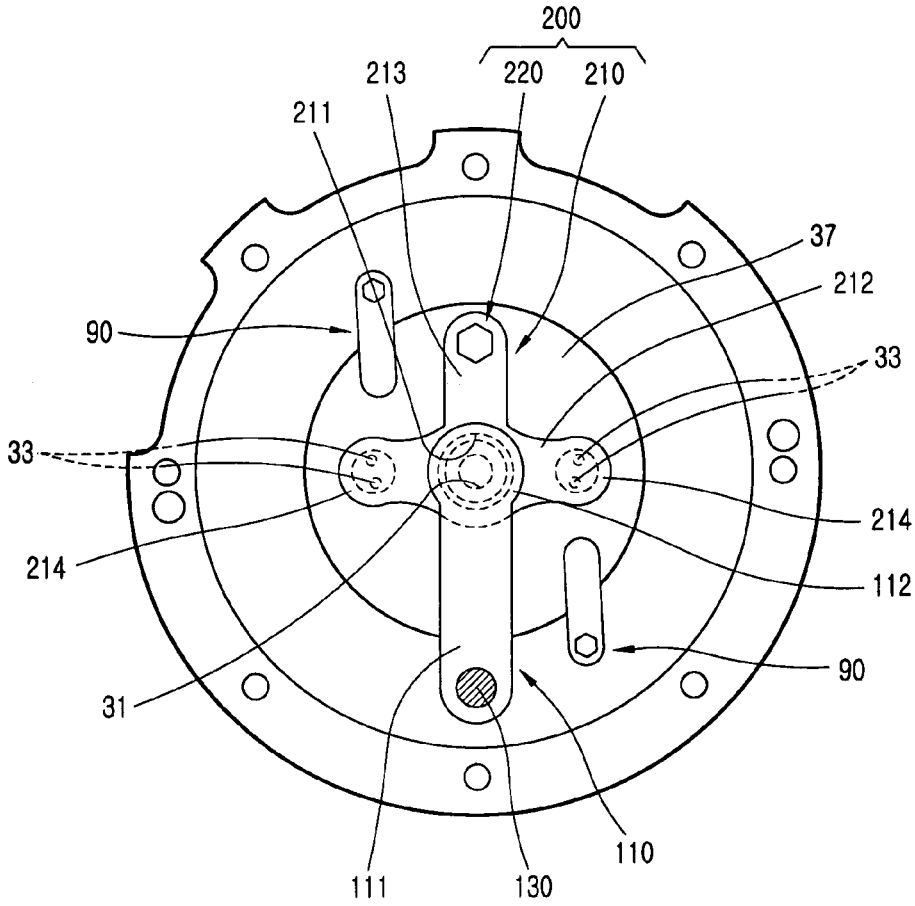
FIGS. 6 and 7 are respectively a front sectional view and a plane sectional view showing the fixed scroll having a discharge valve system of a scroll compressor according to the present invention.
Figure 7:
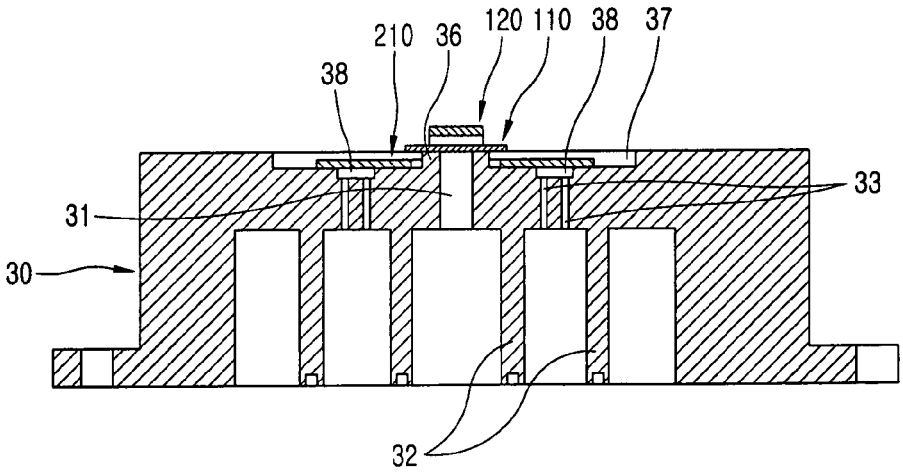
Figure 8:
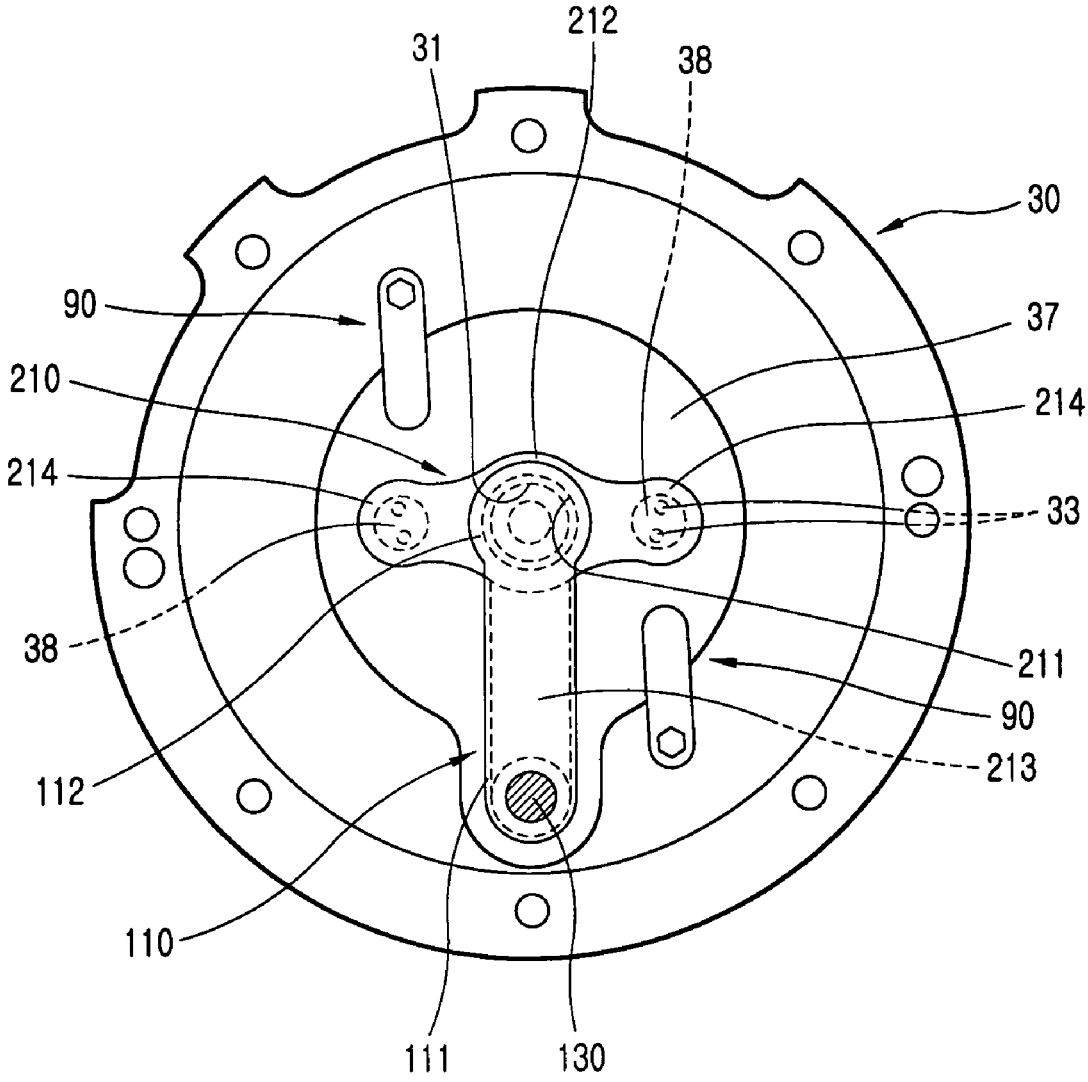
FIGS. 8, 9, 10, and 11 are plane views respectively showing modification examples of an integral bypass valve constituting the discharge valve system of the scroll compressor.

FIGS. 5, 6, and 7 are respectively a perspective view, a plane view, and a front sectional view showing a fixed scroll having a discharge valve system of a scroll compressor according to one embodiment of the present invention.

As shown, in the discharge valve system of the scroll compressor according to the present invention, a discharge hole 31 is penetratingly formed at a fixed scroll 30 constituting a compression part, and discharge bypass holes 33 are penetratingly formed at the fixed scroll 30 to be positioned at both sides of the discharge hole 31.

The discharge hole 31 is positioned at a center portion of the fixed scroll 30, and a protruded valve seat portion 36 having a certain width, an outer diameter, and a height is formed at an edge of the discharge hole 31. The protruded valve seat portion 36 is protruded by a groove 37 that the periphery of the protruded valve seat portion 36 is formed with a certain depth. An upper surface of the protruded valve seat portion 36 is in contact with a discharge valve assembly 100, including discharge valve 110, retainer 120 and fixing bolt 130. The protruded valve seat portion 36 can be protruded at an upper surface of the fixed scroll 30 with a certain height.

The discharge bypass holes 33 positioned at one side of the discharge hole 31 are composed of two holes. The two discharge bypass holes 33 are positioned in a circular groove 38 having a certain inner diameter and a depth. An edge of the circular groove 38 is formed at a position lower than the upper surface of the protruded valve seat portion 36. In case that the protruded valve seat portion 36 is protruded at the upper surface of the fixed, the edge surface of the circular groove 38 having the discharge bypass holes 33 therein can be the upper surface of the fixed scroll 30.

The discharge valve assembly 100 for opening and closing the discharge hole 31 is fixedly coupled to the fixed scroll 30. The discharge valve assembly 100 is composed of: a discharge valve 110 formed as a thin plate of a certain shape, for opening and closing the discharge hole 31; a retainer 120 for limiting a motion of the discharge valve 110; and a first fixing bolt 130 for fixing one side of the discharge valve 110 and the retainer 120 to the fixed scroll 30. The discharge valve 110 is composed of: an opening/closing portion 111 formed as a certain shape, for opening and closing the discharge hole 31; and an elastic supporting portion 112 extendingly formed at one side of the opening/closing portion 111 with a certain length and fixed to the fixed scroll 30 by the first fixing bolt 130.

An integral bypass valve assembly 200 for interworking the discharge valve assembly 100 and for opening and closing the discharge bypass holes 33 positioned at both sides of the discharge hole 31 is mounted at the fixed scroll 30.

The integral bypass valve assembly 200 is composed of: an integral bypass valve 210 formed as a thin plate of a certain shape and overlapped with the discharge valve 110, for opening and closing the discharge bypass holes 33; and a second fixing bolt 220 for fixing one side of the integral bypass valve 210 to the upper surface of the fixed scroll 30.

The integral bypass valve 210 is composed of: a disc portion 212 having a through hole 211 larger than the discharge hole 31 therein; an elastic fixing portion 213 extendingly formed at one side of the disc portion 212 as a certain length and to one side thereof, the second fixing bolt 220 is coupled; and opening/closing portions 214 extendingly formed at both sides of the disc portion 212 with a certain shape. A bolt hole for inserting the second fixing bolt 220 is formed at one side of the elastic fixing portion 213.

The integral bypass valve 210 is positioned at the upper surface of the fixed scroll 30 so that the protruded valve seat portion 36 can be inserted into the through hole 211 and the opening/closing portions 214 can respectively cover the discharge bypass holes 33 positioned at both sides of the discharge hole 31. The second fixing bolt 220 constituting the discharge valve assembly 100 is penetratingly inserted into the elastic fixing portion 213 thereby to be coupled to the upper surface of the fixed scroll 30. That is, the integral bypass valve 210 is coupled to the fixed scroll 30 with the discharge valve assembly 100. At this time, the integral bypass valve 210 is positioned at a lower side than the discharge valve 110, and the integral bypass valve 210 and the discharge valve 110 are almost overlapped with each other.

Figure 9:
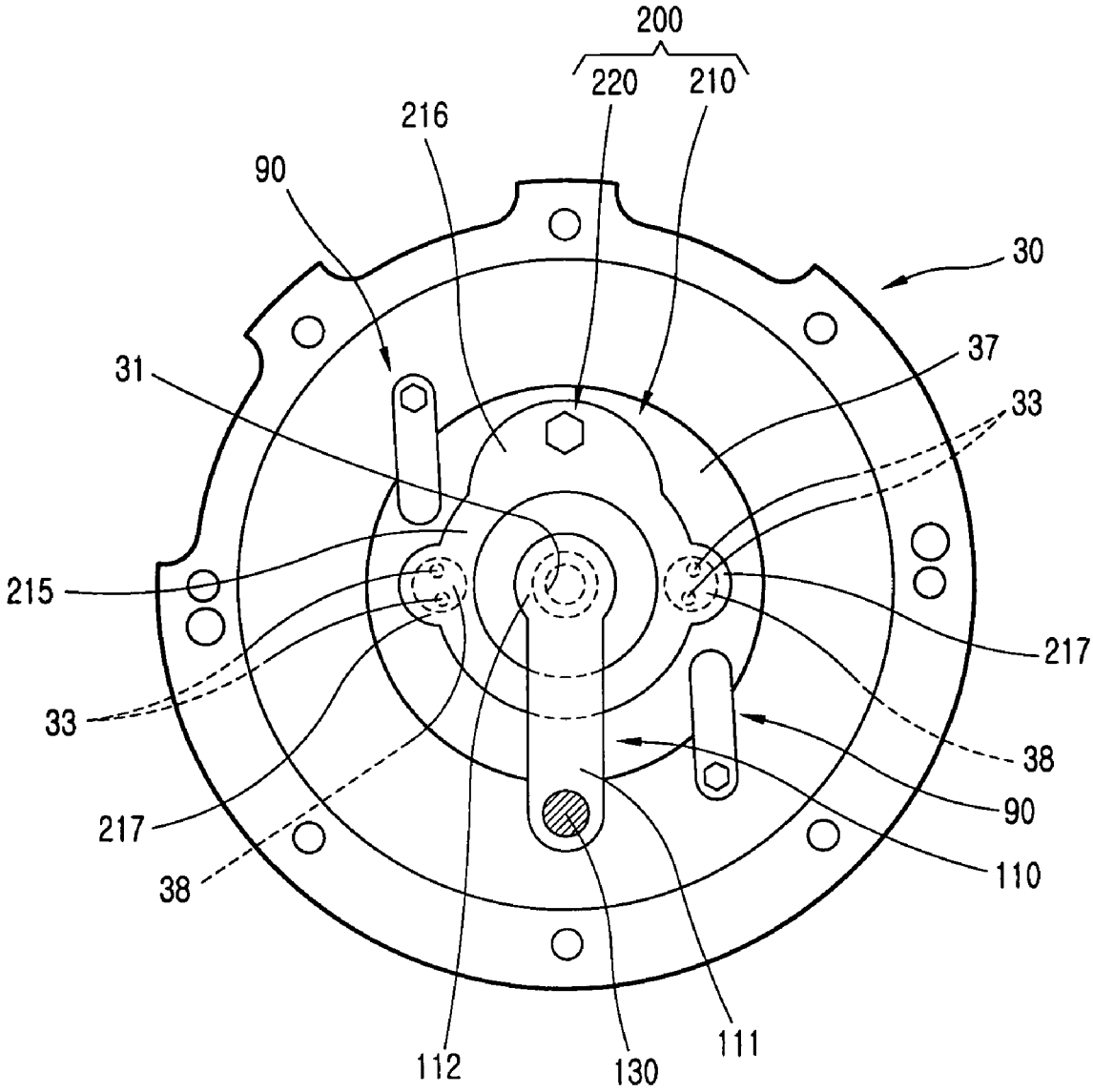

As a modification example of the integral bypass valve 210, as shown in FIG. 9, the integral bypass valve 210 is composed of: a ring-shaped elastic portion 215 formed as a ring shape having a certain width; a fixing portion 216 fixed at one side of the ring-shaped elastic portion 215 by the second fixing bolt 220; and opening/closing portions 217 extendingly formed at both sides of the ring-shaped elastic portion 215 with a certain shape, for opening and closing the discharge bypass holes 33 positioned at both sides of the discharge hole 31. An inner diameter of the ring-shaped elastic portion 215 is larger than that of the discharge hole 31. A bolt hole for inserting the second fixing bolt 220 is formed at the fixing portion 216.

The integral bypass valve 210 is positioned at the upper surface of the fixed scroll 30 so that the protruded valve seat portion 36 formed at the edge of the discharge hole 31 can be positioned in the ring-shaped elastic portion 215 and the opening/closing portions 217 can cover the discharge bypass holes 33. The second fixing bolt 220 is penetratingly inserted into the fixing portion 216 thereby to be coupled to a screw hole (not shown) formed at the fixing scroll 30. At this time, the integral bypass valve 210 is positioned at a lower side than the discharge valve 110, and the integral bypass valve 210 and the discharge valve 110 are overlapped with each other at one part. The second fixing bolt 220 and the first fixing bolt 130 are positioned at opposite sides to each other on the basis of the discharge hole 31.

Figure 10:
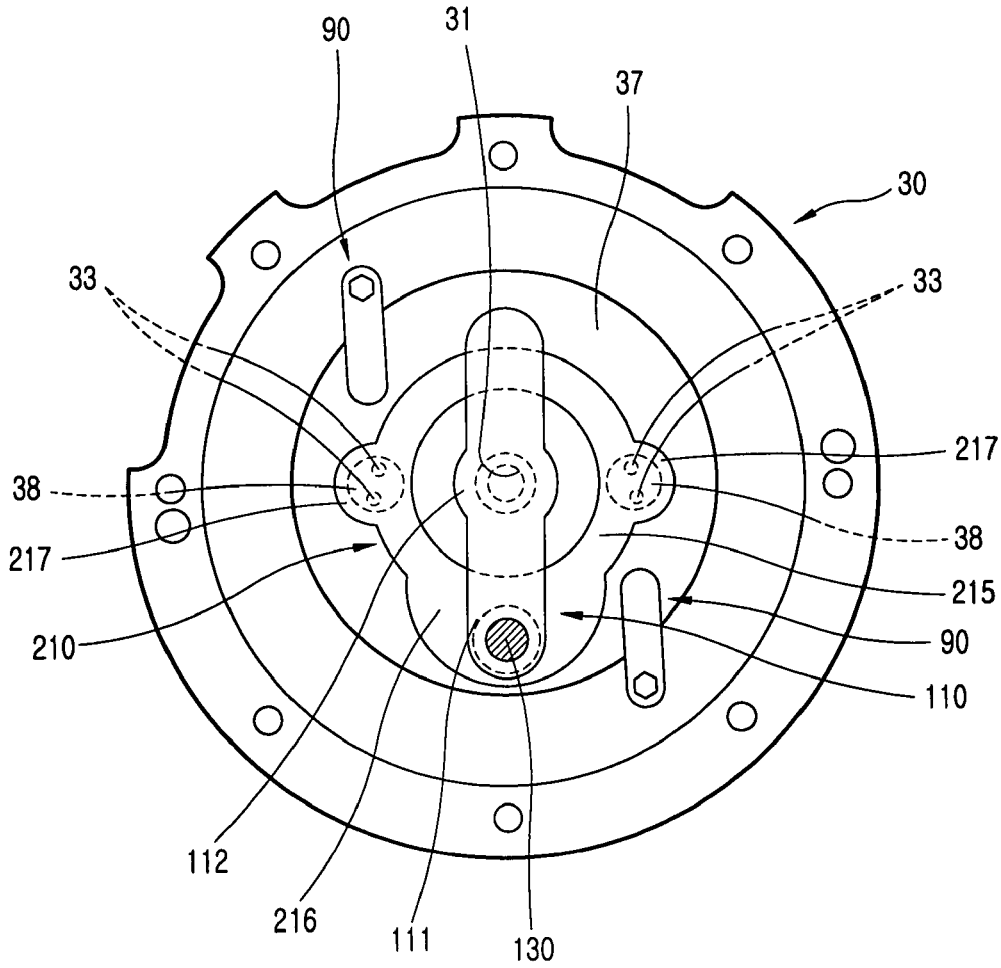

As shown in FIG. 10, the integral bypass valve 210 is positioned at the upper surface of the fixed scroll 30 so that the protruded valve seat portion 36 formed at the edge of the discharge hole 31 can be positioned in the ring-shaped elastic portion 215 and the opening/closing portions 217 can respectively cover the discharge bypass holes 33. The first fixing bolt 130 constituting the discharge valve assembly 100 is penetratingly inserted into the fixing portion 216 thereby to be coupled to the fixed scroll 30. At this time, the integral bypass valve 210 is positioned at a lower side than the discharge valve 110. That is, the integral bypass valve 210 is coupled to the fixed scroll 30 with the discharge valve assembly 100. At this time, a part of an opening/closing portion 112 of the discharge valve 110 is extendingly formed as a certain length thereby to be overlapped with the integral bypass valve 210. According to this, the integral bypass valve 210 and the discharge valve 110 are overlapped with each other at two parts.

Figure 11:
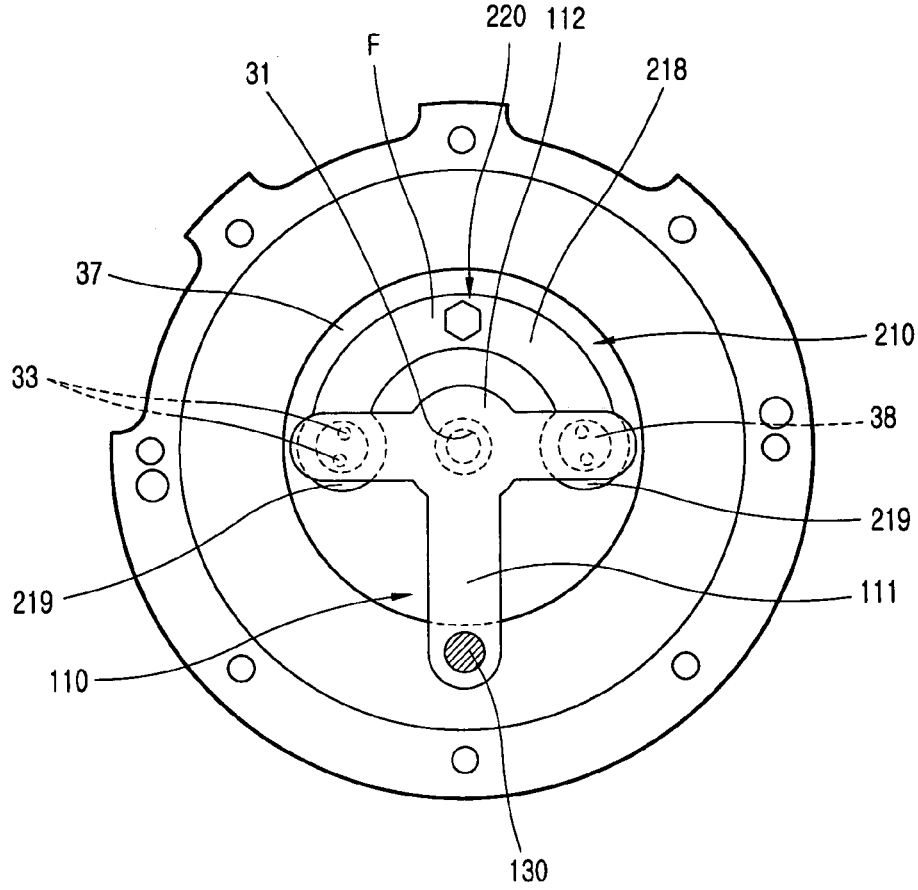

As another embodiment of the integral bypass valve 210, as shown in FIG. 11, the integral bypass valve 210 is composed of: a circular elastic portion 218 formed as a circular shape having a certain width and positioned to cover the discharge hole 31; opening/closing portions 219 respectively formed at both ends of the circular elastic portion 218 as a certain shape, for opening and closing the discharge bypass holes 33 respectively positioned at both sides of the discharge hole 31; and a fixed portion F positioned in the middle of the circular elastic portion 218 and fixed by the second fixing bolt 220. At this time, the second fixing bolt 220 and the first fixing bolt 130 are positioned at opposite sides to each other on the basis of the discharge hole 31. The opening/closing portions 219 of the integral bypass valve 210 are positioned at a lower portion of the opening/closing portion 112 of the discharge valve, and are respectively overlapped with a part of the opening/closing portion 112.

Both sides of the opening/closing portion 112 of the discharge valve are extendingly formed as a certain length.

An unexplained reference numeral 35 denotes a driving bypass hole, and 90 denotes a driving bypass valve assembly.

Hereinafter, operation effects of the discharge valve system of the scroll compressor will be explained as follows.

An operation of the compression part of the scroll compressor having the discharge valve system is the same as the aforementioned one, thereby omitting its explanation.

In case that the scroll compressor having the discharge valve system according to the present invention is driven in a high pressure ratio, the orbiting scroll 40 performs an orbiting movement and thereby a plurality of compression pockets P formed by the wrap 41 of the orbiting scroll 40 and the wrap 32 of the fixed scroll 30 move towards a middle portion of the fixed scroll 30. At the same time, volumes of the compression pockets P are gradually varied thereby to gradually compress gas. The discharge valve 110 is bent by a pressure difference between the compression pockets P and a high pressure region of a hermetic container 10 thereby to open the discharge hole 31. The compressed gas is discharged through the discharge hole 31 positioned in the middle portion of the fixed scroll 30. At this time, since the high pressure region of the hermetic container 10 maintains a high pressure state, the integral bypass valve 210 blocks the discharge bypass holes 33 by the pressure. Since the discharge valve 110 is positioned at a higher position than the integral bypass valve 210, the discharge valve 110 is not interworked with the integral bypass valve 210.

Figure 12:
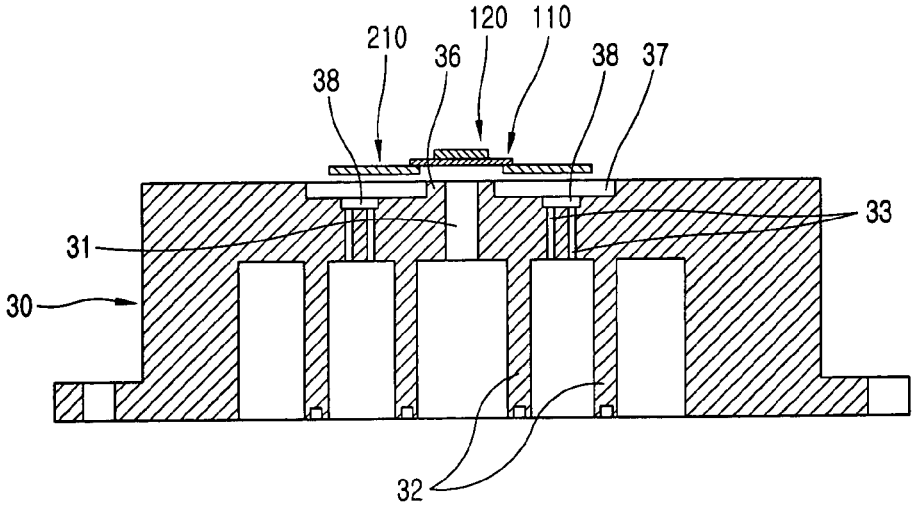
FIG. 12 is a front sectional view showing an operation state of the discharge valve system of the scroll compressor according to the present invention.

In case that the scroll compressor having the discharge valve system according to the present invention is driven in a low pressure ratio, the orbiting scroll 40 performs an orbiting movement and thereby the plurality of compression pockets P formed by the wrap 41 of the orbiting scroll 40 and the wrap 32 of the fixed scroll 30 move towards a middle portion of the fixed scroll 30. At the same time, volumes of the compression pockets P are gradually varied thereby to gradually compress gas. As shown in FIG. 12, since the high pressure region of the hermetic container 10 maintains a relatively low pressure, the integral bypass valve 210 is bent by a pressure of the compressed gas thereby to open the discharge bypass holes 33. According to this, the compressed gas is discharged through the discharge bypass holes 33. Also, the integral bypass valve 210 pushes the discharge valve 110 overlapped with the integral bypass valve 210 at the time of being bent thereby to open the discharge hole 31. According to this, a part of gas that has not been sufficiently discharged through the discharge bypass holes 33 is discharged through the discharge hole 31. One side of the integral bypass valve 210 is fixed by the first fixing bolt 130 or the second fixing bolt 220, and another side thereof is bent by an elastic force.

A pressure of gas discharged through the discharge bypass hole 33 is relatively lower than that of gas discharged through the discharge hole 31 in a high pressure ratio operation. Since the high pressure region of the hermetic container 10 maintains a relatively low pressure, the integral bypass valve 210 is opened.

Also, since gas discharged through the discharge hole 31 is the gas remaining without being discharged through the discharge bypass hole 33, a pressure of the gas discharged through the discharge hole 31 is similar to a pressure of the gas discharged through the discharge bypass hole 33.

In the present invention, gas that has not been sufficiently discharged through the discharge bypass holes 33 in a low pressure ratio driving is discharged through the discharge hole 31, thereby maximizing an amount of discharged gas.

In the discharge valve system of the scroll compressor according to the present invention, the discharge bypass holes 33 respectively positioned at both sides of the discharge hole 31 are opened and closed by the integral bypass valve assembly 200 composed of the integral bypass valve 210 and the fixing bolt 220 for fixing the integral bypass valve 210, thereby greatly reducing the number of components. Especially, in case that the integral bypass valve 210 is fixed by the fixing bolt 130 constituting the discharge valve assembly 100, the number of components is much more reduced. In the conventional art, two bypass valve assemblies respectively composed of a bypass valve, a retainer, and a fixing bolt are provided thereby to have six components. However, in the present invention, one integral bypass valve assembly constituted with the bypass valve 210 and the fixing bolt 220 is provided thereby to have two components. According to this, the number of components is reduced thereby to greatly reduce the number of assembly processes, and the upper structure of the fixed scroll 30 is simplified.

As aforementioned, in the discharge valve system of the scroll compressor according to the present invention, a discharge amount of gas is maximized in a low pressure ration driving of the scroll compressor thereby to enhance a discharge efficiency. Also, the number of components is greatly reduced thus to reduce a fabrication cost, thereby enhancing a competitiveness of the product. Also, the number of assembly processes is greatly reduced thereby to enhance an assembly productivity.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A discharge valve system of a scroll compressor comprising:

a fixed scroll having a discharge hole and discharge bypass holes;

a discharge valve assembly mounted at the fixed scroll, for opening and closing the discharge hole by a pressure difference; and an integral bypass valve assembly mounted at the fixed scroll, for opening and closing the bypass holes and interworking the discharge valve assembly;

wherein the integral bypass valve assembly comprises:

an integral bypass valve formed as a thin plate of a certain shape, for opening and closing the discharge bypass holes; and a fixing bolt for fixing one side of the integral bypass valve to an upper surface of the fixed scroll;

wherein the integral bypass valve comprises:

a disc portion having a through hole larger than the discharge hole therein, the discharge hole being positioned in the through hole;

an elastic fixing portion extendingly formed at one side of the disc portion as a certain length and to one side thereof, the fixing bolt is coupled; and opening/closing portions extendingly formed at both sides of the disc portion as a certain shape, for respectively opening and closing the discharge bypass holes formed at both sides of the discharge hole.

2. The discharge valve system of claim 1, wherein the integral bypass valve assembly comprises:

an integral bypass valve formed as a thin plate of a certain shape, for opening and closing the discharge bypass holes; and a fixing bolt constituting the discharge valve assembly, for fixing one side of the integral bypass valve to an upper surface of the fixed scroll.

3. The discharge valve system of claim 2, wherein the integral bypass valve comprises:

a disc portion having a through hole larger than the discharge hole therein, the discharge hole being positioned in the through hole;

an elastic fixing portion extendingly formed at one side of the disc portion as a certain length and to one side thereof, a fixing bolt of the discharge valve assembly is coupled; and opening/closing portions extendingly formed at both sides of the disc portion as a certain shape, for opening and closing the discharge bypass holes formed at both sides of the discharge hole.

4. The discharge valve system of claim 2, wherein the integral bypass valve comprises:

a ring-shaped elastic portion formed as a ring shape having an inner diameter larger than that of the discharge hole and having a certain width, and positioning the discharge hole therein;

a fixing portion fixed at one side of the ring-shaped elastic portion by the fixing bolt of the discharge valve assembly; and opening/closing portions extendingly formed at both sides of the ring-shaped elastic portion as a certain shape, for opening and closing the discharge bypass holes positioned at both sides of the discharge hole.

5. The discharge valve system of claim 1, wherein the discharge valve assembly and the integral bypass valve assembly are overlapped with each other.

6. The discharge valve system of claim 5, wherein the discharge valve assembly and the integral bypass valve assembly are overlapped with each other at one part or two parts.

7. The discharge valve system of claim 1, wherein the integral bypass valve assembly is positioned at a lower side than the discharge valve assembly.

8. The discharge valve system of claim 7, wherein a height of a valve seat of the discharge hole opened and closed by the discharge valve assembly is higher than that of a valve seat of the discharge bypass holes opened and closed by the integral bypass valve assembly.

9. The discharge valve system of claim 8, wherein a cylindrical protruded valve seat portion having a certain width and height is formed at an edge of the discharge hole, the protruded valve seat portion is inserted into the integral bypass valve assembly thereby to open and close the discharge bypass holes positioned at both sides of the discharge hole, and the discharge valve assembly is in contact with an upper surface of the protruded valve seat portion.

10. The discharge valve system of claim 1, wherein the integral bypass valve comprises:

a ring-shaped elastic portion formed as a ring shape having an inner diameter larger than that of the discharge hole and having a certain width, and positioning the discharge hole therein;

a fixing portion fixed at one side of the ring-shaped elastic portion by the fixing bolt; and opening/closing portions extendingly formed at both sides of the ring-shaped elastic portion as a certain shape, for opening and closing the discharge bypass holes positioned at both sides of the discharge hole.

11. The discharge valve system of claim 1, wherein the integral bypass valve comprises:

a circular elastic portion formed as a circular shape having a certain width and positioned to cover the discharge hole;

opening/closing portions respectively formed at both ends of the circular elastic portion as a certain shape, for opening and closing the discharge bypass holes respectively positioned at both sides of the discharge hole; and a fixed portion positioned at a middle portion of the circular elastic portion and fixed by the fixing bolt.

12. A discharge valve system of a scroll compressor comprising:

a fixed scroll having a discharge hole and discharge bypass holes;

a discharge valve assembly mounted at the fixed scroll, for opening and closing the discharge hole by a pressure difference;

an integral bypass valve for opening and closing the bypass holes and interworking the discharge valve assembly; and a fixing bolt for fixing one side of the integral bypass valve to an upper surface of the fixed scroll, wherein the integral bypass valve comprises:

a disc portion having a through hole larger than the discharge hole therein, the discharge hole being positioned in the though hole;

an elastic fixing portion extendingly formed at one side of the disc portion as a certain length and to one side thereof the fixing bolt is coupled; and opening/closing portions extendingly formed at both sides of the disc portion as a certain shape, for respectively opening and closing the discharge bypass holes formed at both sides of the discharge hole.

13. The discharge valve system of claim 12, wherein the opening/closing portions are positioned in a line.

* * * * *